United States Patent [19]

Ketler et al.

[11] 4,002,895

[45] Jan. 11, 1977

[54] ILLUMINATING APPARATUS

[75] Inventors: Albert E. Ketler, Indiana; Ronald P. Campbell, Latrobe; George Shacreaw, Blairsville, all of Pa.

[73] Assignee: Ocean Energy Inc., Blairsville, Pa.

[22] Filed: June 6, 1975

[21] Appl. No.: 584,621

Related U.S. Application Data

[62] Division of Ser. No. 462,886, April 22, 1974, Pat. No. 3,953,725.

[52] U.S. Cl. ..... 240/60; 240/10.6 R

[51] Int. Cl.[2] ..... F21L 3/00; F21L 15/08

[58] Field of Search ..... 240/10.6 R, 11.4 R, 240/59, 60

[56] References Cited

UNITED STATES PATENTS

| | | | |
|---|---|---|---|
| 1,586,701 | 6/1926 | Reppa | 240/60 X |
| 1,743,235 | 1/1930 | Raster | 240/60 |
| 2,066,811 | 1/1937 | Wheat | 240/60 X |
| 3,133,705 | 5/1964 | Eickelman | 240/60 |
| 3,227,866 | 1/1966 | Peters et al. | 240/60 X |
| 3,283,144 | 11/1966 | Rogers | 240/10.6 R X |
| 3,331,958 | 7/1967 | Adler | 240/10.6 R |
| 3,604,920 | 9/1971 | Niles | 240/11.2 R X |
| 3,749,902 | 7/1973 | Drew | 240/60 X |
| 3,767,904 | 10/1973 | Cook | 240/11.4 X |

*Primary Examiner*—Joseph F. Peters, Jr.
*Attorney, Agent, or Firm*—Michael Williams

[57] ABSTRACT

The invention relates broadly to a fluorescent lamp construction adapted for use with hats or caps worn by workers in various occupations. The so-called hard hats are now largely worn by workers in hazardous locations, such as mining, construction, service and the like, and our improved fluorescent lamp construction is especially suited for attachment to a hard hat and the invention includes new and novel connection means.

The fluorescent lamp is contained within an oblong housing that is removably held horizontally at the front of the hard hat and the lamp is energized by a battery which is carried on the person of the worker, such as by means of a carrying case having a clip for connecting it to a belt worn by the worker.

To achieve a high level of light output at low temperatures, the invention includes means for conserving heat generated by the fluorescent lamp. Also, to reduce glare, the invention includes a new and novel means for dispersing the light from the lamp.

5 Claims, 14 Drawing Figures

67a
80

81
14
80
14
81
82
67a 83
67
21
60
50
20
23
22
24

ILLUMINATING APPARATUS

This is a division of application Ser. No. 462,886 filed Apr. 22, 1974 now U.S. Pat. No. 3,953,725.

BACKGROUND AND SUMMARY

Insofar as we are aware, the prior art in cap lamps is largely limited to the incandescent bulb type, commonly worn by persons working underground in mines. Standard lamps of this type consume about 4 watts of power and produce about 50 lumens projected like a flashlight in a narrow beam. In an attempt to enlarge the beam size, such lamps have been defocused so that the spot size diverges to a larger ring, but the light intensity then becomes lower.

In the black regions of a coal mine with wall emisitivity ranging from 1 to 4 percent, considerably more light is required to work safely. Roof bolts projecting down from the ceiling, trolley tracks and holes in the floor, pillars, roof support posts, and the myriad obstructions in coal mines are difficult to see with the present cap lamp, and the miner is required to continually move his head in a scanning fashion to identify obstructions which could be hazardous. Although these problems are commonly known in mining operations, similar problems are also present in other operations, such as in construction, service and the like.

In our improved fluorescent lamp construction, the lamp operates at a power level of about 4 watts, but the light output is approximately 300 lumens. Although the light does not focus in a narrow spot, the great increase in light output, as compared with the incandescent bulb type, makes this a significant improvement in visability and, therefore, safety for the workman. Because of the lateral length of the fluorescent lamp, and the reflector associated therewith, the resulting light pattern is horizontal and quite wide, so that the workman may easily view a fairly wide expanse in front of him, without moving his head side-to-side or up and down.

DESCRIPTION OF THE DRAWINGS

In the drawings accompanying this specification and forming a part of this application, there are shown, for purposes of illustration, several embodiments which our invention may assume, and in these drawings.

DESCRIPTION OF PREFERRED EMBODIMENT

Figures 1, 13, 14:
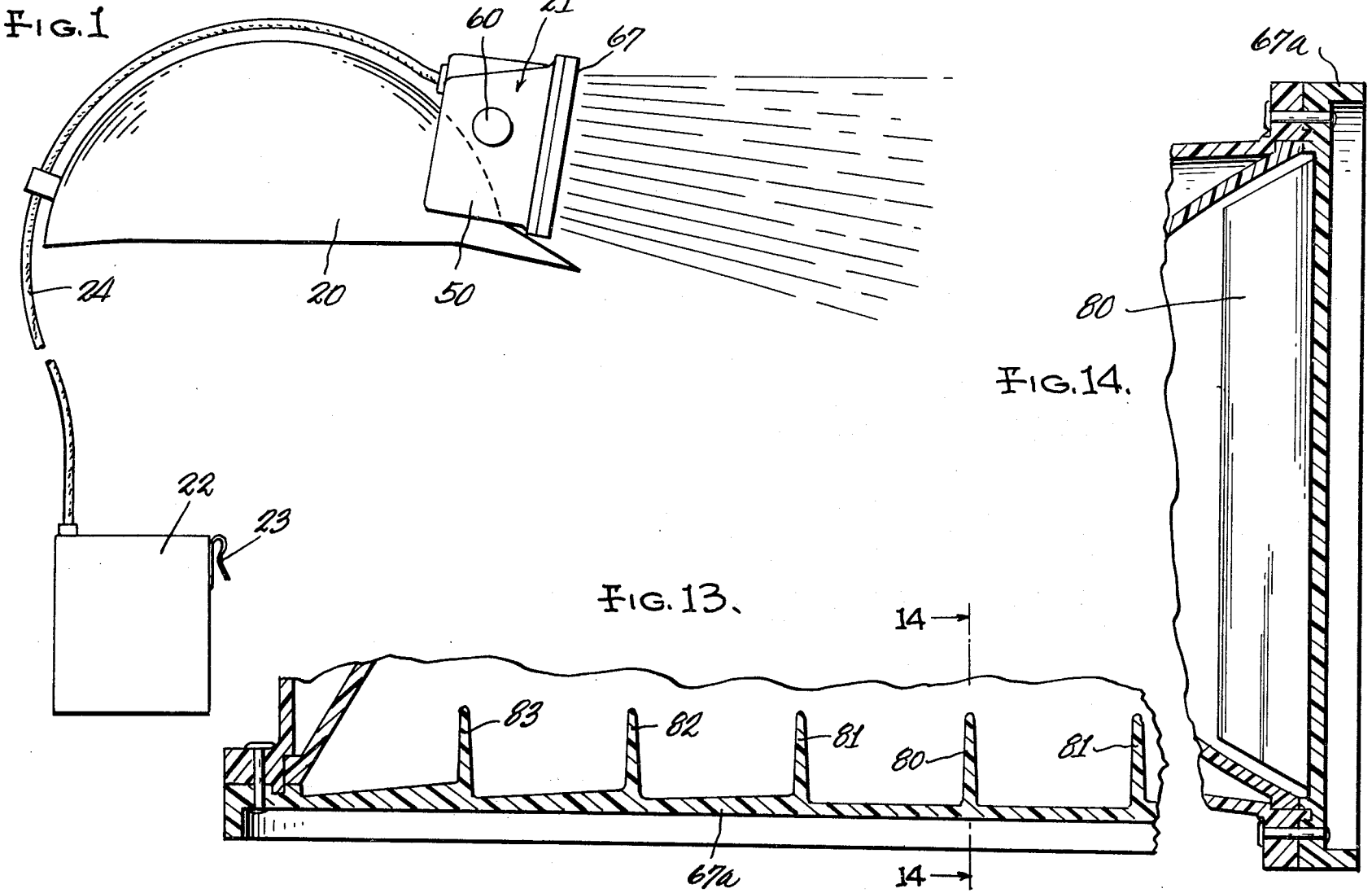
FIG. 1 is a small scale, side elevational view of the improved lamp connection to a hard hat, and a battery to energize the same.
FIG. 13 is a fragmentary, sectional view, illustrating another embodiment for reducing side glare from the lamp.
FIG. 14 is a fragmentary sectional view corresponding to the line 14—14 of FIG. 13.

As seen in FIG. 1, our improved cap lamp is adapted for connection to the forward portion of a hard hat 20, and comprises an oblong housing 21 which is preferably disposed horizontally, as shown. The lamp receives power from a rechargeable battery 22 which has a clip 23 so that it may be suspended from a belt (not shown) worn by a workman. A power cord 24 extends from the battery to the housing 21 and for safety purposes, especially in mining operations, the cord and its connections are sealed to minimize sparking.

Figures 2, 3, 8, 9, 10, 11, 12:
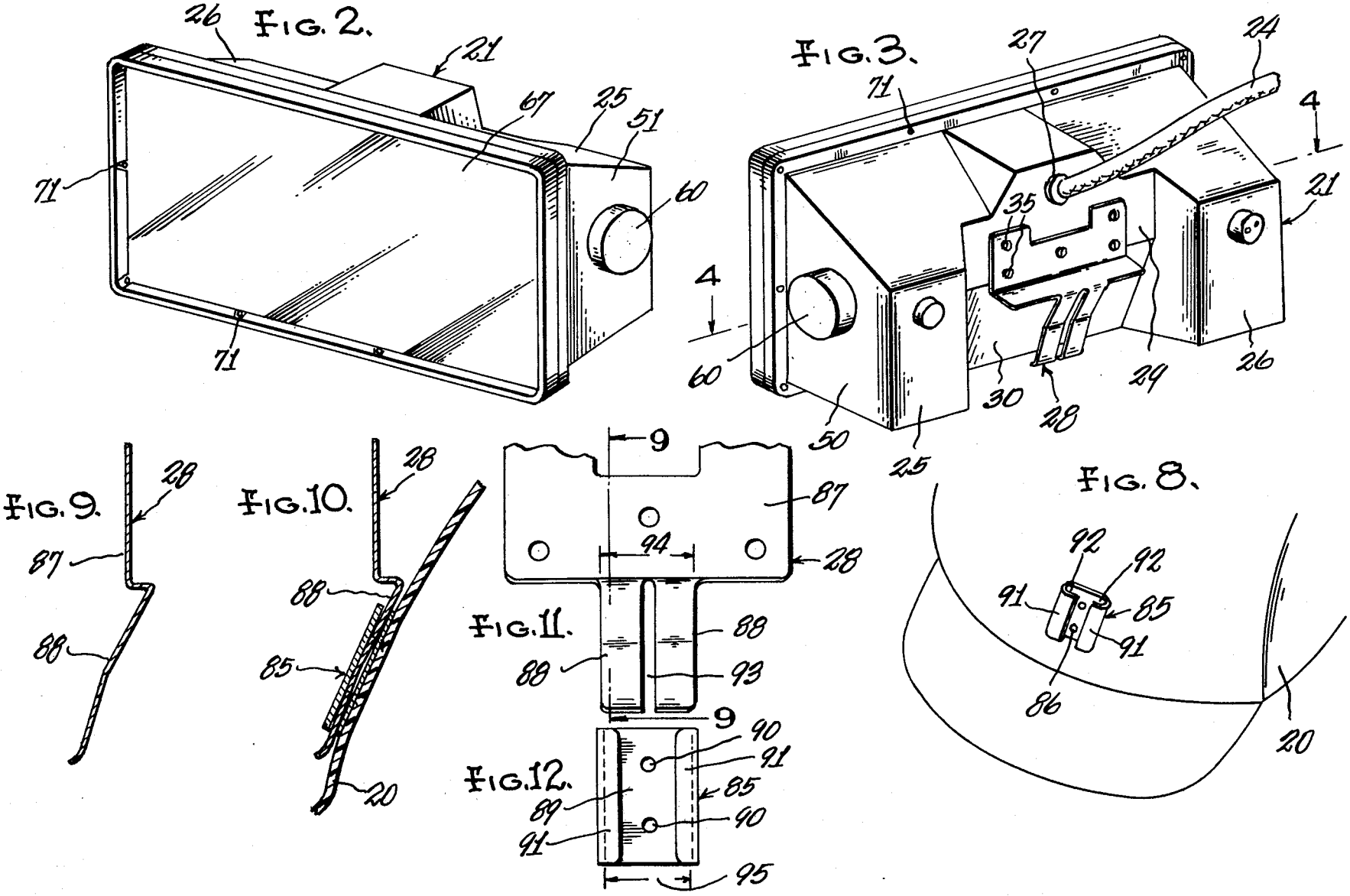
FIGS. 2 and 3 are small scale perspective views of the lamp, looking at the front and rear, respectively.
FIG. 8 is a fragmentary perspective view of a hard hat to which the lamp is connected.
FIG. 9 is an enlarged sectional view through a clip finger, corresponding to the line 9—9 of FIG. 11.
FIG. 10 is a view similar to FIG. 9 but showing the clip finger in assembled relation with a holder on the hard hat.
FIG. 11 is a fragmentary plan view of the clip connection.
FIG. 12 is a plan view of the clip holder.

As seen in the perspective views of FIGS. 2 and 3, the housing is preferably rectangular, as viewed from the front, and has enlarged side pockets 25, 26 at the rear to house circuit components and connection wiring. The power cord 24 enters the rear of the housing at a central upper portion thereof, as seen at 27, and a clip connection 28, to be described in detail later, is connected to a central, inwardly recessed wall 29, the lower portion of which inclines forwardly, as seen at 30. The recessed wall 29 and rear side pockets enable the housing to engage the curved forward portion of the hard hat at three places to provide for stability of the assembly.

Figures 4, 5, 6, 7:
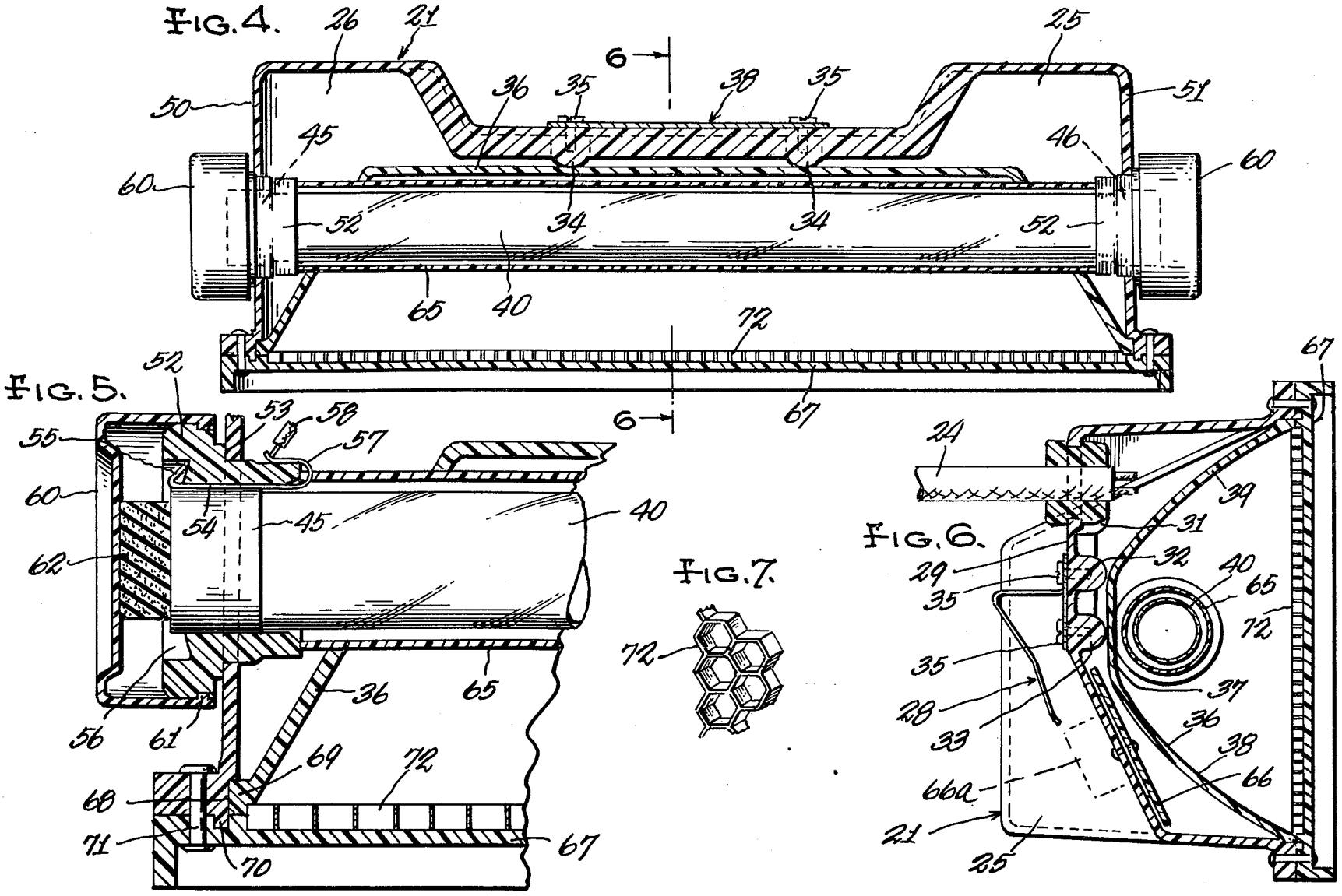
FIG. 4 is an enlarged, sectional view corresponding to the line 4—4 of FIG. 3.
FIG. 5 is an enlarged, fragmentary sectional view of one end portion of the construction shown in FIG. 4.
FIG. 6 is a transverse sectional view corresponding to the line 6—6 of FIG. 4.
FIG. 7 is a fragmentary perspective view of a detail.

As seen in FIGS. 4 and 6, three horizontal ribs 31, 32 and 33 project forwardly from the inner surface of the wall 29, the ribs 32 and 33 having horizontally spaced nubs 34 to which are threaded screws 35 for holding the clip connection 28 to the housing. The nubs 34 on the lower rib 33 also provide locating means against which the rear surface of the reflector 36 abuts, as seen in FIG. 6. The reflector presently preferred is not parabolic in section, but rather has a fairly straight central portion 37 leading to oppositely outer curved portions 38, 39.

The central section 37 of the reflector is disposed immediately behind a fluorescent tube 40 which, as seen in FIGS. 4 and 6, is a round, straight tube having a central active length and end portions 45, 46 which constitute the opposite end terminals and which contain the ballast electrodes. As seen in FIG. 4, the reflector 36 reflects light emanating from the central active length of the tube, while the end portions 45, 46 are contained within opaque end structures, so that the net effect is a smaller, lighter weight lamp assembly which offers a less bulky head gear and also has a better visual effect than a full width reflector.

As seen in FIG. 4, opposite end walls 50, 51 of the housing 21 are provided with openings to receive insulating bushings 52 which are similar in construction and which are preferably made of polycarbonate. Each bushing is of stepped cross section to provide a shoulder 53 which abuts the exterior surface of the respective end wall of the housing. Each bushing, in the area of the shoulder 53 is cemented or ultrasonically welded to the respective housing end walls 50, 51. Opposite end terminals 45, 46 of the fluorescent lamp are seated within respective bushings 52. Electrical connector clips 54 have a central portion engageable with a respective end terminal (45 or 46) of the fluorescent tube. One end portion 55 of the connector clip is contained within an end recess 56 formed in a respective bushing 52, while the opposite end portion 57 is disposed within a pocket 25, or 26 of the housing, for connection to a circuit wire 58. An opaque, plastic cap 60 has its skirt portion attached to a respective bushing 52 to seal against entrance of any hazardous material, such as a methane gas in mines, from entering the housing. As seen in FIG. 5, the cap skirt portion has an annular rib 61 seating behind a shoulder on the bushing, and the cap is preferably cemented to the bushing to prevent unauthorized access to the housing interior in this area. In order to maintain the fluorescent tube in central position and to resiliently hold it against axial displacement, foam rubber spacers 62 are disposed between the opposite ends of the tube and the inner surface of a respective cap 60.

A characteristic of fluorescent lamps is that the light output reduces with declining temperatures. Thus, if the lamp is energized at a low temperature, for example 0° F, it is important to conserve every bit of heat generated within the lamp to raise its temperature as quickly as possible and thereby achieve a higher level of light output. We have solved this problem by disposing the fluorescent lamp 40 within a transparent plastic tube 65 which is only slightly larger in inside diameter than the external diameter of the fluorescent lamp. This creates a small volume of still air around the fluorescent tube to act as a thermal-insulation barrier which is transparent enough to transmit light outward with a minimum of absorption. A preferred plastic for the tube 65 is a cellulose acetate butgrate (CAB) because of its superior optical properties and relatively low cost. In areas where low temperatures are not encountered, the tube 65 may be omitted.

A support board 66, of electrical insulating material, is attached to the inclined wall 30, as by rivets or the like, as seen in FIG. 6. The support board 66 has opposite end portions extending into the pockets 25, 26 of the housing, and circuit components 66*a*, such as a transistor, capacitor, resistors, inductor, and transformer, are mounted on such end portions, the pockets providing adequate space for the same.

A lens 67 closes the open front end of the housing 21 and is preferably of the same rectangular shape as such opening. The lens is made of plastic, such as polycarbonate plastic. As seen in FIG. 5, the housing at its front opening, is formed with a peripheral undercut to provide a recess 68, and a ribbed portion 69 of the reflector is seated in this recess. The housing 21 has a fowardly extending peripheral rib 70 which seats in a corresponding recess formed in the lens 67, and the housing lens and reflector are firmly held assembled in any suitable manner, such as by rivets 71, to prevent unauthorized entry into the housing in this area. The interfitting ribs and recesses provide a seal to restrict entrance of hazardous material, such as methane gas in mines, from entering the housing.

In some cases, glare from the light emanating from the fluorescent tube, may be objectionable, particularly to a person looking at the light from a side thereof. We have reduced this glare, with out materially obstructing transmission of light through the lens 67, by placing a thin section of aluminum honeycomb material 72 directly inside the lens, as seen in FIGS. 4, 5 and 6. FIG. 7 is a fragmentary perspective view showing a portion of this material and it may be held in place by cementing its peripheral edge to the inside surface of the lens, or may be held in any other suitable manner, such as by pinching a peripheral portion between the reflector and lens. It will be appreciated that the honeycomb construction will reduce light levels from oblique angles.

Another construction to reduce glare is shown in FIGS. 13 and 14 which are fragmentary reproductions of the lens area only of FIGS. 4 and 6. In this construction, the lens 67*a* is also preferably made of polycarbonate plastic, and is molded to provide a plurality of vertical ribs (three ribs being shown on opposite sides of a central rib). It will be noted that the lens 67*a* is thin and flat on opposite sides of the center rib 80 to the next adjacent ribs 81—81. Between ribs 81 and 82, the thickness of the lens tapers from a thicker portion at the rib 81 to a thinner portion at the rib 82. This varying thickness also exits between ribs 82 and 83, and between rib 83 and the end of the lens, with the thickness at the thicker portions gradually increasing, as seen in FIG. 13. If glare is not objectionable, the lens may be formed simply as a flat, thin, plane of plastic, such as it would be if the honeycomb material 72 where removed from FIGS. 4, 5 and 6.

A portion of the hard hat 20 is shown in perspective in FIG. 8 and is disposed adjacent to FIG. 3 to illustrate a metal holder 85 which is attached to the front portion of the hat, as by rivets 86. The holder 85 is adapted to receive the clip connection 28 secured to the housing 21 to effect a detachable connection between the hat and housing. The connection is unique in that it restricts front-to-back movement of the housing relative to the hat, and also restricts side-to-side movement of the housing.

Referring particularly to FIGS. 9 through 12, the clip connection 28 is preferably formed as a stamping from sheet metal, preferably stainless steel that is spring tempered after the stamping and forming operations. The clip connection comprises a base plate 87 having holes to pass the screws 35 which hold it to the hard hat. A pair of fingers 88 extend downwardly from the base plate 87 and include portions that are angularly related, as seen in FIG. 9. The holder 85 may also be formed of stainless steel and comprises a flat body portion 89 having holes 90 to pass the rivets 86 which secure it to the front portion of the hard hat 20. Opposite sides of the body portion 89 are folded over, as shown at 91, to form receiving spaces 92 for receiving side portions of respective fingers 88.

Each space 92 is of a depth that is less than the angular relation of the finger portions so that when the fingers are pushed into the spaces, they tend to flatten the angularity of the portions, and this restricts front-to-back movement of the housing 21. As seen in FIG. 11, the fingers 88—88 are separated by a slot 93. The lateral dimension 94 of the fingers is slightly greater than the dimension 95 between opposed interior wall surfaces of the holder 85 so that when the fingers 88 are pushed into the spaces 92, the fingers are spring-pressed toward each other, and this restricts side-to-side movement of the housing 21.

We claim:

1. In combination:

a hard hat of the type worn by workers in hazardous occupations, said hat having a transversely curved front portion, an oblong housing formed of light weight material, a fluorescent tube lamp mounted within said housing to extend parallel with the longer axis thereof, said housing having an elongated opening in its front wall aligned with said tube lamp to pass light rays, and said housing having its rear wall inwardly recessed to receive the transversely curved front portion of said hard hat, and means connecting said housing to said hard hat with said longer axis extending generally horizontally when said hat is worn in normal manner by a worker.

2. The construction according to claim 1 wherein said housing has side pockets in its rear wall at opposite longitudinal ends, said side pockets forming therebetween the inward recess in said rear wall, said inward recess having a wall portion engaging a central part of said transversely curved front portion of said hat, and said side pockets each having a wall portion engaging said transversely curved portion of said hat on opposite sides of said central part to provide three point engagement for stability.

3. The construction according to claim 2 wherein said connecting means comprises two parts, one part carried the central part of said transversely curved front portion of said hat, and the other part carried by the wall portion of the inward recess of said housing rear wall.

4. The construction according to claim 3 wherein said one part of the connecting means is a bracket having a U-shaped cross-section, and the other part of the connecting means is a spring clip that seats in said bracket.

5. In combination:

a hard hat of the type worn by workers in hazardous occupations, an oblong housing formed of lightweight material, a fluorescent tube lamp mounted within said housing having an elongated opening in its front wall aligned with said tube lamp to pass light rays, and means connecting said housing to the front of said hat with the longer axis of said housing extending generally horizontally when said hat is worn in normal manner by a worker, said connecting means comprising a metal spring clip secured to the rear wall of said housing and a metal holder secured to the front portion of said hat, said clip having a pair of offspring fingers in side-by-side but slightly spaced relation, each finger having angularly related longitudinal portions, said holder having a base portion secured to said hat and side portions bent over said base to form a pair of side spaces, each of said fingers being projectable within a respective side space and when within the same having the angularity of its longitudinal portions and the lateral distance between said fingers reduced by frictional engagement with adjoining portions of said holder whereby to tightly fit said clip within said holder to restrict front-to-back movement of said housing relative to said hat and also to restrict side-to-side movement of said housing relative to said hat.

* * * * *